US006880966B1

(12) United States Patent
Cappellino et al.

(10) Patent No.: US 6,880,966 B1
(45) Date of Patent: Apr. 19, 2005

(54) INLINE HIGH TURBULENCE MIXER HAVING COMBINED OBLIQUE AND TRANSVERSE STATIONARY VANES

(75) Inventors: Charles A. Cappellino, Seneca Falls, NY (US); Douglas Paddock, Penn Yan, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/704,810

(22) Filed: Nov. 10, 2003

Related U.S. Application Data

(63) Continuation of application No. 10/199,591, filed on Jul. 17, 2002, now abandoned.

(51) Int. Cl.[7] ..... B01F 5/04; B01F 7/32
(52) U.S. Cl. ..... 366/171.1; 366/307; 366/325.94
(58) Field of Search ..... 366/307, 302, 366/303, 304, 305, 306, 262, 265, 171.1, 366/172.2, 174.1, 325.94

(56) References Cited

U.S. PATENT DOCUMENTS 4,339,206 A 7/1982 Ahs
4,577,974 A 3/1986 Prough et al.
4,834,547 A 5/1989 Niskanen
4,886,577 A 12/1989 Wiley
5,258,100 A 11/1993 Niskanen et al.
5,263,774 A 11/1993 Delcourt
5,279,709 A 1/1994 Niskanen
5,378,321 A 1/1995 Delcourt
5,536,368 A 7/1996 Mäkelä et al.
5,575,559 A 11/1996 Roll ..... 366/171.1
5,791,778 A 8/1998 Manninen et al.
5,813,758 A 9/1998 Delcourt et al.
6,193,406 B1 2/2001 Peltonen et al.

*Primary Examiner*—Tony G Soohoo
(74) *Attorney, Agent, or Firm*—Ware, Fressola, Van Der Sluys & Adolphson LLP

(57) ABSTRACT

An inline mixer has a casing and a rotor. The casing has an inlet for receiving a chemical and a process flow media, an inner surface defining a cavity therein, a stationary vane arranged obliquely on the inner surface in relation to the direction of flow of the chemical and process flow media, a transverse stationary vane arranged on the inner surface substantially perpendicularly in relation to the direction of flow of the chemical and process flow media, and an outlet for providing a mixture of the chemical and process flow media. The rotor is arranged in the cavity of the casing and has rotary vanes that rotatably cooperate with the stationary vane and the transverse stationary vane for mixing the chemical and process flow media. The transverse stationary vane is a straight or bent plate in relation to the direction of flow of the mixture.

18 Claims, 6 Drawing Sheets

INLINE HIGH TURBULENCE MIXER HAVING COMBINED OBLIQUE AND TRANSVERSE STATIONARY VANES

This application is a continuation of application Ser. No. 10/199,591, filed on Jul. 17, 2002, now abandoned.

BACKGROUND OF THE INVENTION

1. Field of Invention

The present invention relates to a mixer; and more particularly relates to an inline mixer used to mix one or more chemicals with a process flow media.

2. Description of Related Art

Inline mixers, such as that shown in FIGS. 1–3, are used to mix one or more chemicals with a process flow media.

FIG. 1 shows a casing 10 of one such known inline mixer having an inlet 12 for receiving the chemical and process flow media for mixing and an outlet 14 for providing a mixture thereof. The chemical is injected into the process flow upstream of the inline mixer. In FIGS. 1 and 3, the casing 10 has a stationary vane 18 that is a continuous vane arranged around and on an inner surface 10*a* of the casing 10 at an oblique angle relative to the direction of flow of the chemical and process flow media.

FIG. 2 shows a rotor 16 having a set of three rotary vanes 16*a*, 16*b*, 16*c* that is inserted into the casing 10. The stationary vane 18 interacts with the set of three rotating vanes 16*a*, 16*b*, 16*c* to create turbulence and shear to promote the mixing of the chemical and the process flow media. The vane configuration shown in FIGS. 1 and 3 provides the high shear and turbulence required for good mixing of chemicals that have been added upstream of the chemical mixer. However, the angled stationary vane 18 as shown in FIGS. 1 and 3 allows some portion of the chemical flow to bypass the mixing zone by flowing under or over the combined rotating/stationary vane system. This flow bypass reduces the mixing effectiveness, causing non-uniform concentrations of chemical(s), resulting in the need to add additional chemicals or accept less than desired mixing performance.

In comparison, Roll (U.S. Pat. No. 5,575,559) discloses a mixer for mixing multi-phase fluids having stationary casing vane(s) at an angle oblique to both the process flow and the axis of the rotor, as well as having a transverse vane or rib placed parallel to the axis of rotation of the rotary vanes, and perpendicular to the process flow media. However this mixer design does not mix well, i.e. the "mixing effectiveness" is not high enough.

In view of this, there is a need in the industry for an improved inline mixer architecture to that known in the art.

SUMMARY OF INVENTION

In its broadest sense, the present invention provides a new and unique inline mixer used to mix one or more chemicals with a process flow media having a casing and a rotor arranged therein.

The casing has an inlet for receiving the chemical and process flow media, an inner surface defining a cavity therein, one or more stationary vanes arranged obliquely on the inner surface in relation to the direction of flow of the chemical and process flow media, a transverse stationary vane arranged on the inner surface substantially perpendicularly in relation to the direction of flow of the chemical and process flow media, and an outlet for providing a mixture of the chemical and process flow media.

The rotor is arranged in the cavity of the casing and has rotary vanes that rotatably cooperate with the one or more stationary vanes and the transverse stationary vane for mixing the chemical and process flow media.

In one embodiment, the transverse stationary vane is a straight plate and has both ends substantially perpendicular to an axis in the direction of flow of the chemical and process flow media. Alternatively, the transverse stationary vane may be a bent plate having one end or both ends that are acutely angled in relation to the axis in the direction of flow of the chemical and process flow media. In this case, the one or both ends of the transverse stationary vane are angled at an acute angle, such as at about seven degrees, in relation to the axis perpendicular the direction of flow of the chemical and process flow media. The transverse stationary vane is arranged substantially near an inner edge of the inlet. The transverse vane may be rotated at an angle of about 300 about its longitudinal axis parallel to the axis of the rotor.

The inner surface of the cavity of the casing has a cylindrical shape and the rotary vanes have a corresponding cylindrical shape. The inlet and the outlet of the casing may each have a respective flange.

The rotor has a base with one or more rotary blades arranged thereon. Each of the rotary blades may have a radiused opening. Each radiused opening preferably has an oblong shape, but may also have other shapes like circular, oval, etc. The rotor has an inner reinforcing ring connected to the base, an outer reinforcing ring at the distal end thereof that couples two or more of the rotary vanes together, as well as one or more gussets connecting each rotary blade to the outer reinforcing ring.

In operation, the transverse stationary vane near the inlet prevents the chemical from passing under the rotating vanes and helps to direct the chemical flow into the rotating vanes. As discussed above, the transverse inlet vane may be perpendicular or nearly perpendicular to the flow or may be angled to direct the chemical flow and minimize pressure pulsation to the process flow or may be angled to direct the chemical flow and minimize pressure pulsation that can lead to vibration.

Chemicals are injected upstream of the inline mixer and flow into the high turbulence mixer. The transverse inlet vane provides an initial zone of high turbulence. The transverse inlet vane also directs the chemicals into the mixer's highest turbulence zone (created by shear forces generated from rotating vanes passing the stationary vanes) and prevents the injected chemicals from flowing along the bottom of the mixer casing and bypassing the mixer rotor. The combination of initial high turbulence and directing of the chemical flow into the highest turbulence zone of the mixer improves mixing effectiveness, giving the same performance with less chemical addition.

BRIEF DESCRIPTION OF THE DRAWING

The drawing, not drawn to scale, includes the following Figures.

DETAILED DESCRIPTION OF INVENTION

FIGS. 4–7: The Casing 100

Figure 1:
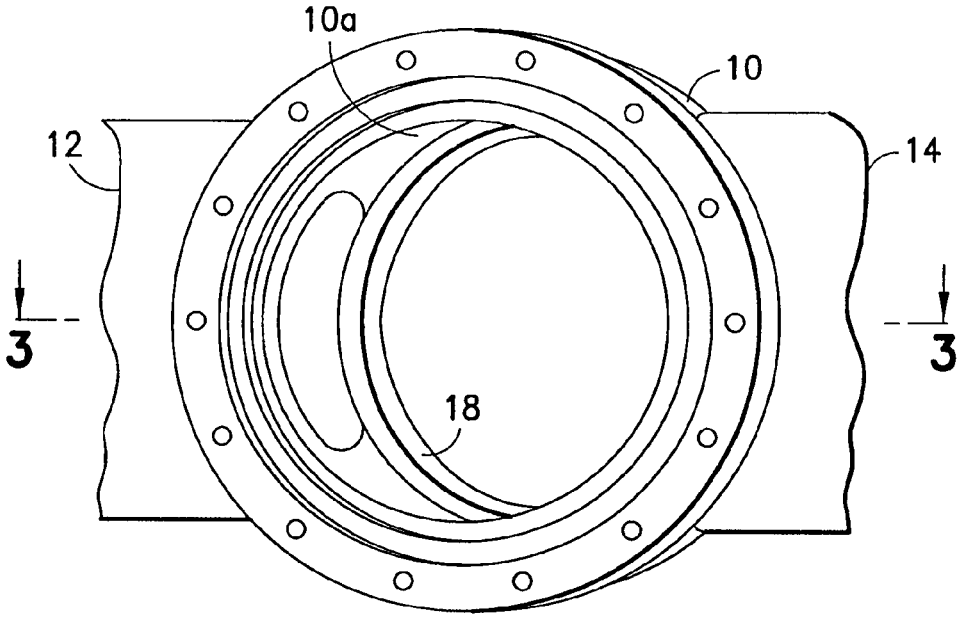
FIG.1 PRIOR ART
FIG. 1 is a perspective view of a casing of a known inline mixer.
Figure 2:
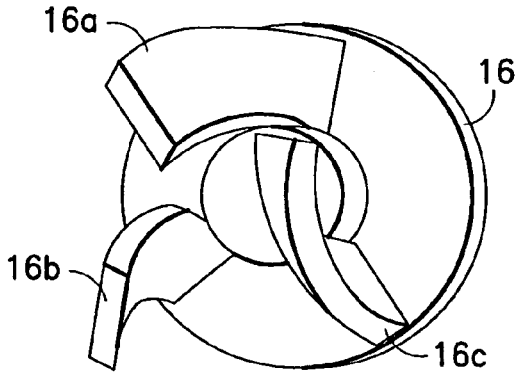
FIG.2 PRIOR ART
FIG. 2 is a perspective view of rotary vanes of the known inline mixer.
Figure 3:
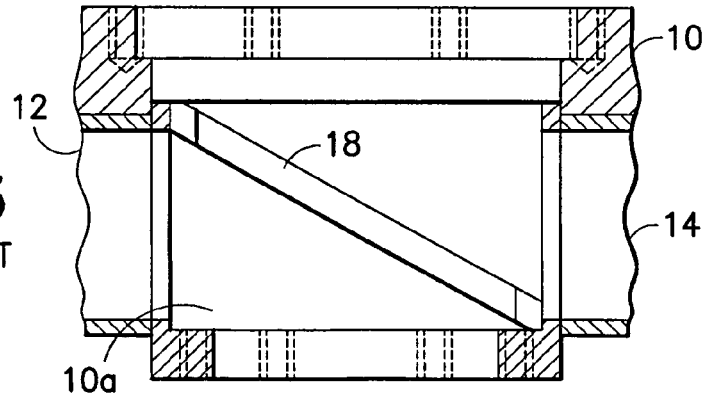
FIG.3 PRIOR ART
FIG. 3 is a top cross-sectional view of the casing along lines 3—3 in FIG. 1.

FIGS. 4–7 show a casing generally indicated as 100 of an inline mixer according to the present invention. The casing 100 has a flange for receiving a rotor assembly shown and described in relation to FIG. 11. Similar elements in FIGS. 4–7 and 11 are labelled with similar reference numerals.

Figure 4:
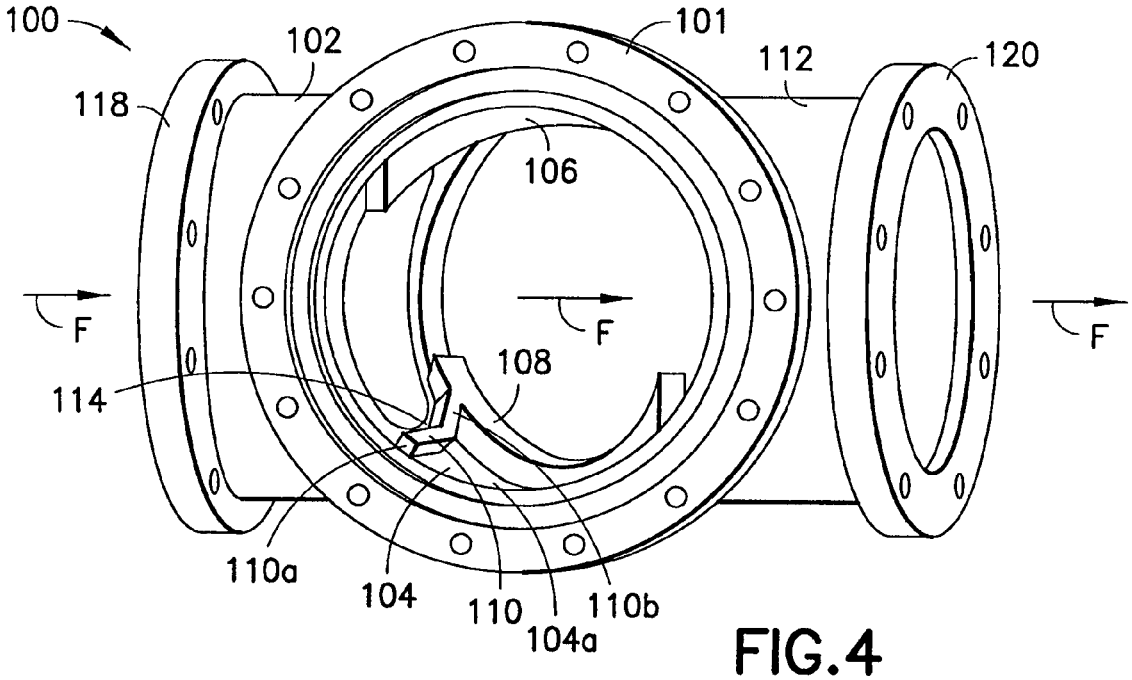
FIG. 4 is a front perspective view of a casing according to the present invention.
Figure 5:
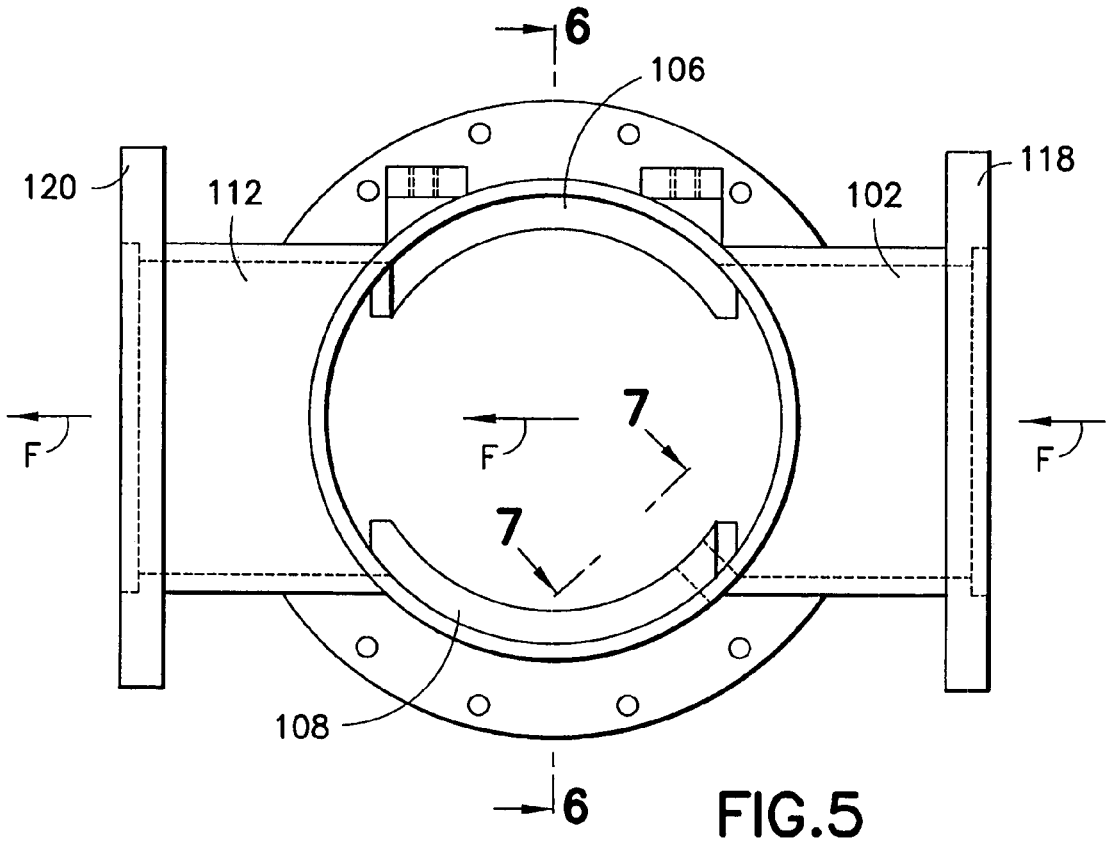
FIG. 5 is a rear view of the casing shown in FIG. 4.
Figure 6:
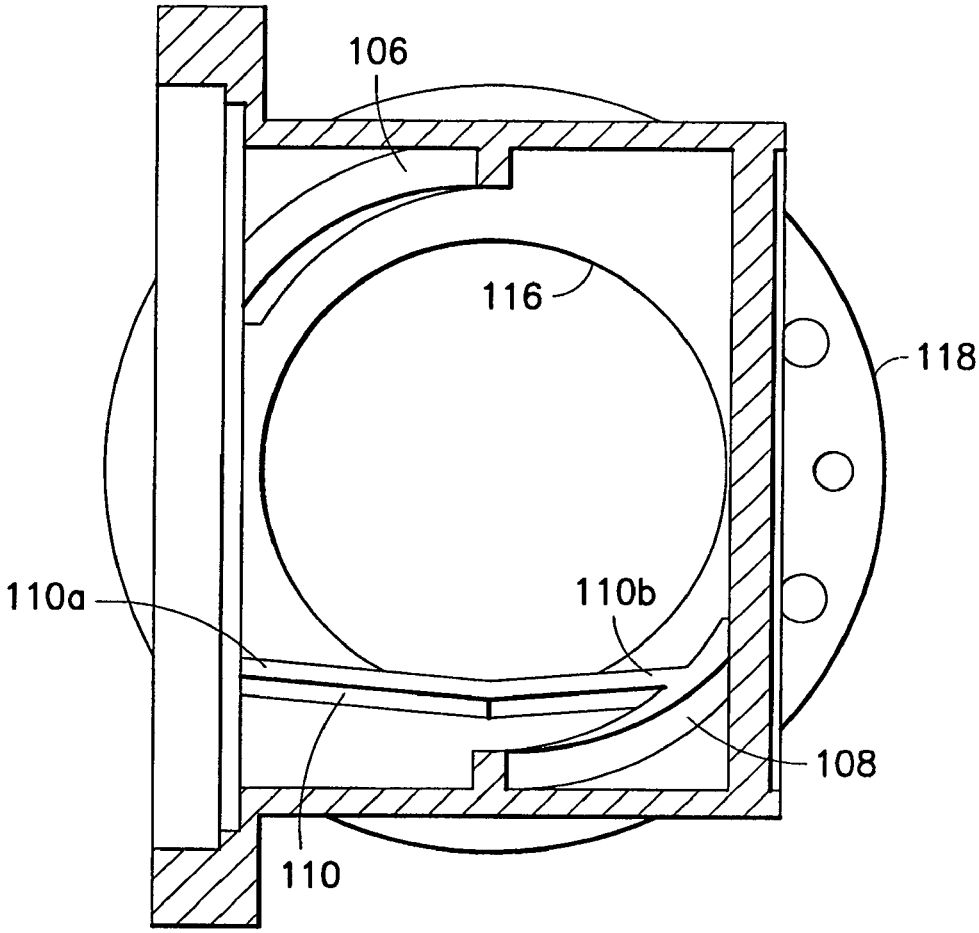
FIG. 6 is a side cross-sectional view of the casing along lines 6—6 in FIG. 5.
Figure 7:
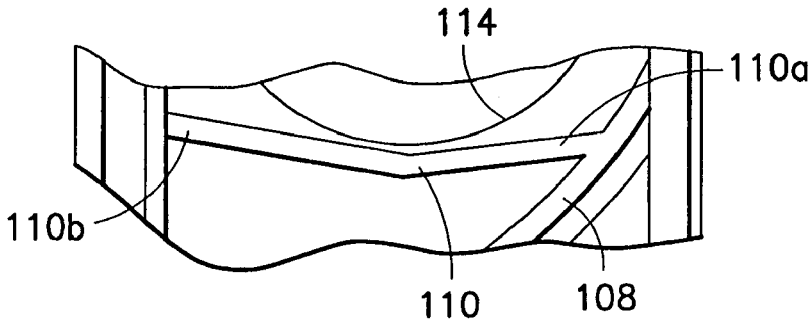
FIG. 7 is a partial cross-sectional view of a transverse stationary vane of the casing along lines 7—7 in FIG. 5.
Figure 8:
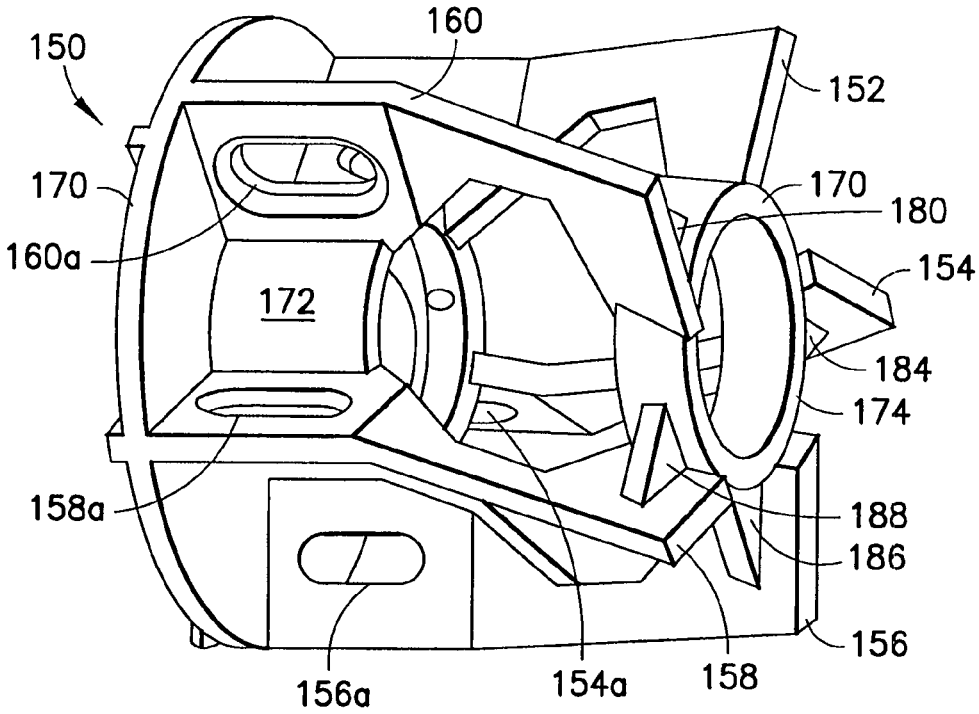
FIG. 8 is a side perspective view of rotor according to the invention.
Figure 9:
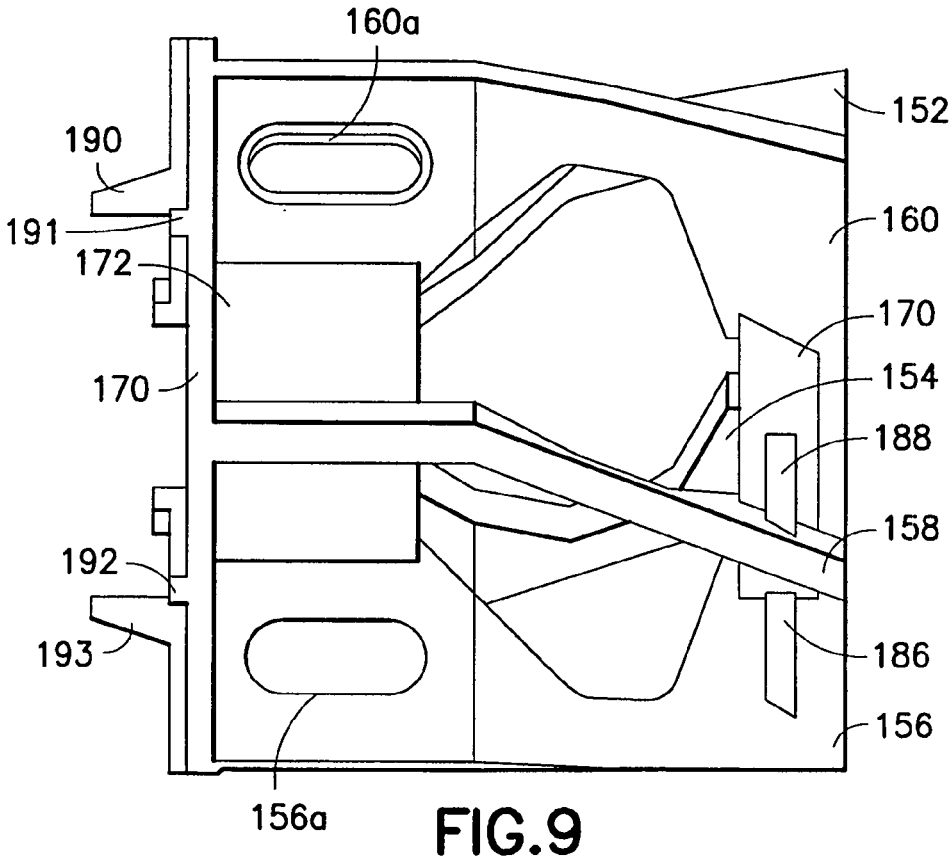
FIG. 9 is a side view of the rotor shown in FIG. 8.

FIG. 4 shows the casing 100 having an inlet generally indicated as 102 for receiving one or more chemicals and a process flow media, not shown, an inner surface 104 defining a cavity therein, one or more stationary vanes 106, 108 arranged obliquely on the inner surface 104 in relation to the direction of flow (which is generally indicated by flow arrows labelled F) of the chemical and process flow media, a transverse stationary vane 110 arranged on the inner surface 104 substantially perpendicular to the direction of flow F of the chemical and process flow media, and an outlet 112 for providing a mixture of the chemical and process flow media from the casing 100.

The transverse stationary vane 110 is a bent plate having two ends 110*a*, 110*b* that are acutely angled in relation to an axis perpendicular to the direction of flow F of the chemical and process flow media. As shown, the two ends 110*a*, 110*b* are acutely angled at about seven degrees in relation to the axis perpendicular to the direction of flow F of the chemical and process flow media. However, the scope of the invention is not intended to be limited to any particular acute angle of the two ends 110*a*, 110*b* in relation to the axis perpendicular to the direction of flow F of the chemical and process flow media. For example, the scope of the invention is intended to include other acute angles. In particular, embodiments are also envisioned in which the two ends 110*a*, 110*b* are angled at an acute angle in a range of about zero (perpendicular) to thirty or more degrees in relation to the direction of flow F of the chemical and process flow media. Moreover, the scope of the invention is intended to include embodiments in which only one of the two ends 110*a*, 110*b* is angled in relation to the direction of flow F of the chemical and process flow media, while the other end 110*a*, 110*b* is not angled. (Compare FIG. 12 below.)

The transverse stationary vane 110 is arranged substantially near an inner bottom edge 114 of the inlet 102. The term "near" is intended to include anywhere from a position at the bottom edge 114 to a position rotated 45° away from the bottom edge 114. However, the scope of the invention is intended to include embodiments in which a transverse stationary vane such as 110 is arranged substantially near the center of the inner surface 104 as generally indicated by way of a point of reference by reference label 104*a*; embodiments in which a transverse stationary vane such as 110 is arranged substantially near a corresponding upper edge 116 of the inlet 102, embodiments in which multiple transverse stationary vanes such as 110 are arranged, as well as embodiments having one or more combinations of the aforementioned. As shown in FIG. 4, the transverse vane 110 is rotated at an angle of about 300 about its longitudinal axis parallel to the axis of the rotor. The scope of the invention is intended to include angling the transverse vane 110 from between 0 to 900 about its longitudinal axis parallel to the axis of the rotor.

The one or more stationary vanes 106, 108 include a pair of separate stationary vanes. However, the scope of the invention is not intended to be limited to only the stationary vane configurations shown and described herein. For example, embodiments are also envisioned having a single, continuous, stationary vane, more than two stationary vanes, as well as other stationary vane configurations in combination with the one or more combinations of the transverse vane configurations discussed above.

The inner surface 104 of the cavity of the casing 100 has a cylindrical shape. The inlet 102 and the outlet 112 each have a respective flange 118, 120 for coupling the casing 100 to other process flow hardware, such as process flow piping or the like.

FIGS. 8–11: The Rotor 150

Figure 11:
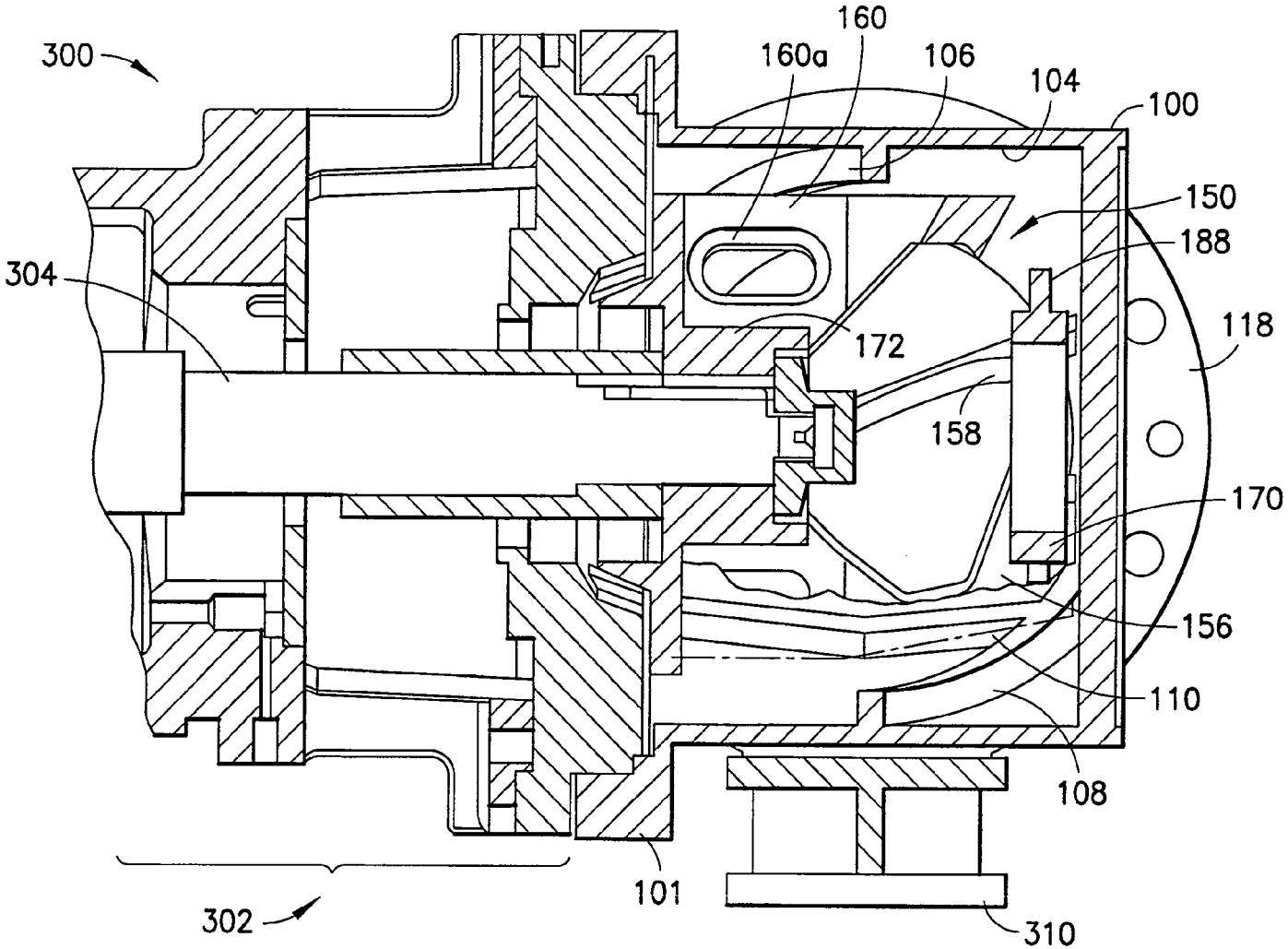
FIG. 11 is a side cross-sectional view of the inline mixer having a rotor arranged in a casing according to the present invention.

The rotor generally indicated as 150 is arranged in the cavity of the casing 100 (FIGS. 4–7), as shown in FIG. 11, and has rotary vanes 152, 154, 156, 158, 160 that rotatably cooperate with the one or more stationary vanes 106, 108 (FIGS. 4–7) and the transverse stationary vane 110 (FIGS. 4–7) for mixing the chemical and process flow media. The rotor 150 is a part of an overall rotor assembly 302 having a rotor shaft 304 shown and described in relation to FIG. 11.

The rotor has a base 170 with five rotary blades 152, 154, 156, 158, 160 arranged thereon. The scope of the invention is not intended to be limited to the number or shape of the rotary vanes 152, 154, 156, 158, 160 shown and described herein. For example, embodiments are envisioned in which the rotor includes one, two, three, four or more than five rotary vanes.

The base 170 has an inner reinforcing ring 172 that couples the rotary vanes 152, 154, 156, 158, 160 together at one end. The rotor 150 has an outer reinforcing ring 174 at the distal end thereof that couples all the rotary vanes 152, 154, 156, 158, 160 together at the other end. The rotor 150 has one or more reinforcing gusseting 180, 184, 186, 188 connecting each rotary vane 152, 154, 156, 158, 160 to the outer reinforcing ring 174. The scope of the invention is not intended to be limited to the number or shape of the reinforcing rings 172, 174 or the reinforcing gusseting 180, 184, 186, 188 shown and described herein. For example, embodiments are envisioned in which the rotor 150 includes more than two reinforcing rings, such as an intermediate reinforcing ring arranged between the two reinforcing rings 172, 174, as well as multiple reinforcing gusseting 180, 184, 186, 188 connecting the rotary vanes 152, 154, 156, 158, 160.

Each of the rotary blades 152, 154, 156, 158, 160 has a respective opening 152*a*, 154*a*, 156*a*, 158*a*, 160*a*. The openings to each vane may be radiused as shown. Each radiused opening 152*a*, 154*a*, 156*a*, 158*a*, 160*a* preferably has an oblong shape, as shown, but may also have other shapes like circular, oval, etc. The scope of the invention is not intended to be limited to the number, shape or location of the radiused opening 152*a*, 154*a*, 156*a*, 158*a*, 160*a*.

Embodiments are also envisioned in which each rotary blade has two or more radiused openings consisting of many different types of configurations.

The rotary vanes 152, 154, 156, 158, 160 have a cylindrical outer shape corresponding to the shape of the inner surface 104 of the cavity of the casing 100.

Figure 10:
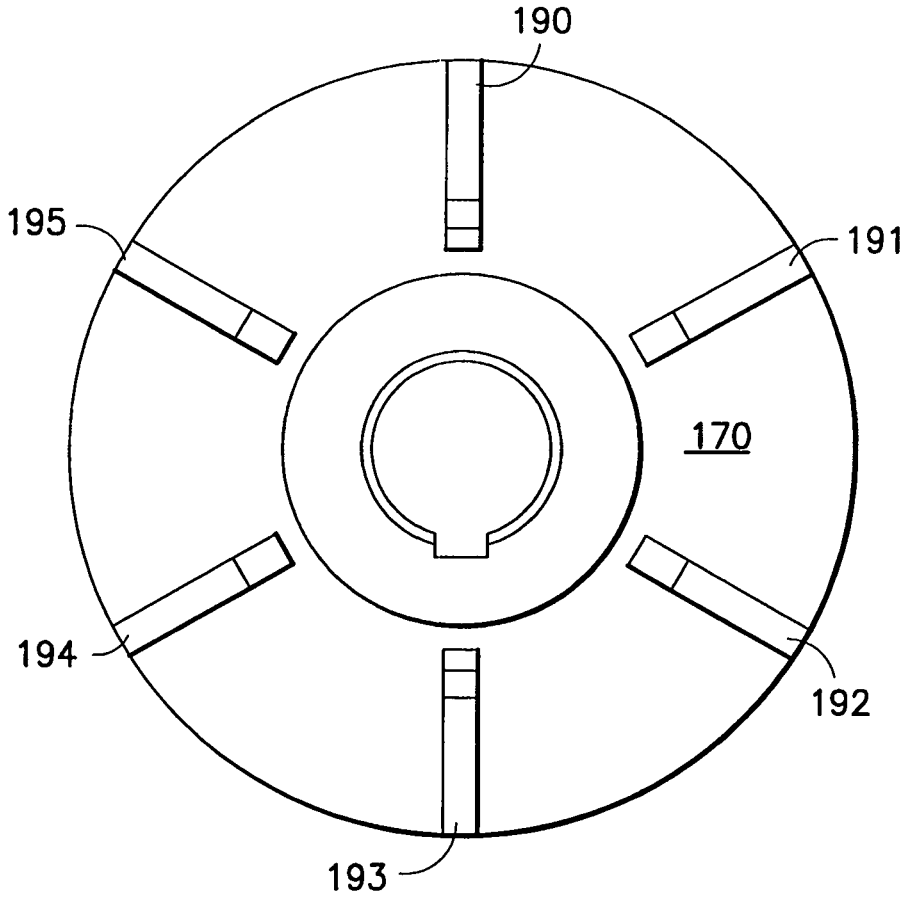
FIG. 10 is a rear view of the rotor shown in FIG. 8.

FIG. 10 show the rear side of the base plate 170 having six bosses 190, 191, 192, 193, 194, 195.

In operation, the transverse stationary vane 110 prevents the chemical from passing under the rotary vanes 152, 154, 156, 158, 160 and helps to direct the flow of the chemical into the rotary vanes 152, 154, 156, 158, 160 for mixing with the process flow media.

FIG. 11: The Combined Structure

FIG. 11 shows a combined structure of an inline mixer generally indicated as 300 having the casing 100 with the rotor 150 arranged therein. Elements in FIG. 11 that are similar to elements in FIGS. 1–10 are provided similar reference numerals. The inline mixer 300 has a rotor assembly generally indicated as 302 coupled to the rotor 150 attached to a shaft 304. The rotor assembly 302 and shaft 304 are shown by way of example and do not form part of the overall invention.

FIG. 11 shows the mixer casing 100 mounted on a casing foot 310, which does not form part of the overall invention. The back end (frame) would be mounted on a frame foot.

As a person skilled in the art would appreciate, the mixer would also typically have a cylindrical roller or ball bearing and a casing gasket, which are not shown in FIG. 11.

Figure 12:
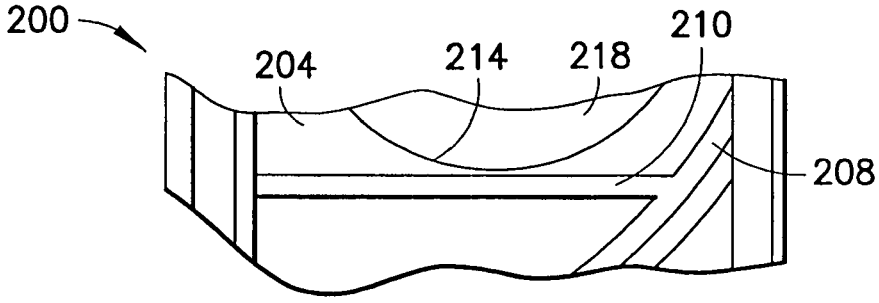
FIG. 12 is a partial view of an alternative embodiment of a transverse stationary vane in a casing according to the present invention.

FIG. 12: The Straight Transverse Vane

FIG. 12 shows an alternative embodiment of a casing mixer 200 for an inline mixer having a stationary vane 208 and a transverse stationary vane 210 that is a straight plate having both ends 210*a*, 210*b* perpendicular to the direction of flow of the chemical and process flow media, which as shown would be flowing out of the page of the drawing. The stationary vane 208 and transverse stationary vane 210 are arranged on the inner surface 204 of the casing 200 near an inner edge 214 of an inlet 218 of the casing 200.

Applications

The list of possible applications for the aforedescribed invention may include:

1) Mixing multiple media to create a homogenous mixture;
2) Mixing multiple liquids;
3) Mixing a liquid into a liquid suspension of solids or fibers;
4) Mixing gases into a liquid;
5) Mixing gases into a liquid suspension of solids or fibers;
6) Mixing two chemicals to promote a reaction;
7) Chemical treatment of fibers;
8) Chemical treatment of fibers used to create paper products;
9) Mixing of two states (i.e. gas and liquid) of a fluid to create a liquid of uniform temperature; and
10) Mixing of steam into a liquid suspension of solids or fibers to create a fluid of uniform temperature.

Scope of the Invention

Accordingly, the invention comprises the features of construction, combination of elements, and arrangement of parts which will be exemplified in the construction hereinafter set forth.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

We claim:

1. An inline mixer used to mix one or more chemicals with a process flow media, comprising:

a casing having an inlet for receiving the chemical and process flow media, an inner surface defining a cavity therein, one or more stationary vanes arranged obliquely on the inner surface in relation to the direction of flow of the chemical and process flow media, a transverse stationary vane arranged on the inner surface substantially perpendicularly in relation to the direction of flow of the chemical and process flow media, and an outlet for providing a mixture of the chemical and process flow media; and a rotor arranged in the cavity of the casing and having rotary vanes that rotatably cooperate with the one or more stationary vanes and the transverse stationary vane for mixing the chemical and process flow media.

2. An inline mixer according to claim 1, wherein the transverse stationary vane is a straight plate and has both ends perpendicular to an axis in the direction of flow of the chemical and process flow media.

3. An inline mixer according to claim 1, wherein the transverse stationary vane is a bent plate and has one end or both ends that are not perpendicular to the direction of flow of the chemical and process flow media.

4. An inline mixer according to claim 3, wherein one or both ends of the transverse stationary vane is angled at an acute angle, including about seven degrees, in relation to an axis perpendicular the direction of flow of the chemical and process flow media.

5. An inline mixer according to claim 1, wherein the transverse stationary vane is arranged substantially near an inner edge of the inlet.

6. An inline mixer according to claim 1, wherein each of the rotary blades has a radiused opening.

7. An inline mixer according to claim 6, wherein each radiused opening has an oblong shape.

8. An inline mixer according to claim 1, wherein the transverse stationary vane prevents the chemical and process flow media from passing under the rotary vanes and helps to direct the flow of the chemical and process flow media into the rotary vanes.

9. An inline mixer according to claim 1, wherein the rotor has an outer reinforcing ring at the distal end thereof that couples two or more of the rotary vanes together.

10. An inline mixer according to claim 9, wherein the rotor has one or more reinforcing gusseting connecting the rotary vanes to the outer reinforcing ring.

11. An inline mixer according to claim 1, wherein the rotor has a base with an inner reinforcing ring that couples two or more of the rotary vanes together.

12. An inline mixer according to claim 1, wherein the one or more stationary vanes includes a pair of stationary vanes.

13. An inline mixer according to claim 12, wherein the rotary vanes have a corresponding cylindrical shape.

14. An inline mixer according to claim 1, wherein the inner surface of the cavity has a cylindrical shape.

15. An inline mixer according to claim 1, wherein the inlet has a flange.

16. An inline mixer according to claim 1, wherein the outlet has a flange.

17. An inline mixer according to claim 1, wherein the rotor has a base with one or more rotary blades arranged thereon.

18. An inline mixer according to claim 1, wherein the transverse vane is rotated at an angle of about 30° about its longitudinal axis parallel to the axis of the rotor.

* * * * *